US009782915B2

(12) United States Patent
Carlsson

(10) Patent No.: US 9,782,915 B2
(45) Date of Patent: Oct. 10, 2017

(54) TRACK DRIVE ADJUSTMENT FOR A GROUND SAWING MACHINE

(71) Applicant: HUSQVARNA AB, Huskvarna (SE)
(72) Inventor: Martin C. Carlsson, Göteborg (SE)
(73) Assignee: HUSQVARNA AB, Huskvarna (SE)

( * ) Notice: Subject to any disclaimer, the term of this patent is extended or adjusted under 35 U.S.C. 154(b) by 0 days.

(21) Appl. No.: 15/111,276

(22) PCT Filed: Jan. 17, 2014

(86) PCT No.: PCT/SE2014/050051
§ 371 (c)(1),
(2) Date: Jul. 13, 2016

(87) PCT Pub. No.: WO2015/108456
PCT Pub. Date: Jul. 23, 2015

(65) Prior Publication Data
US 2016/0332330 A1 Nov. 17, 2016

(51) Int. Cl.
*E01C 23/09* (2006.01)
*B28D 1/04* (2006.01)
(Continued)

(52) U.S. Cl.
CPC ..... *B28D 1/045* (2013.01); *B28D 7/005* (2013.01); *E01C 23/0933* (2013.01); *E02F 5/022* (2013.01); *E02F 5/145* (2013.01)

(58) Field of Classification Search
CPC ..... E01C 23/0933; B28D 7/005; B28D 1/045
See application file for complete search history.

(56) References Cited

U.S. PATENT DOCUMENTS 7,669,589 B2 3/2010 Kingsley et al.
2006/0060179 A1* 3/2006 Kingsley ..... B23D 47/12 125/13.01
(Continued)

FOREIGN PATENT DOCUMENTS

DE 3621251 A1 1/1987
DE 3815639 A1 11/1989
(Continued)

OTHER PUBLICATIONS

International Search Report and Written Opinion of International Application No. PCT/SE2014/050051 mailed Oct. 17, 2014, all enclosed pages cited.
(Continued)

*Primary Examiner* — David Bagnell
*Assistant Examiner* — Michael Goodwin
(74) *Attorney, Agent, or Firm* — McNair Law Firm, P.A.

(57) ABSTRACT

The present invention relates to a ground sawing machine comprising a frame supported by rear wheels (34*a*, 34*b*) and front wheels (36*a*, 36*b*) arranged for moving the ground sawing machine over a surface (38). At least one motor (40, 6) and a saw blade (2) are mounted to the frame, at least one motor (40) being arranged to propel the saw blade (2) to cut against the surface (38). The pointing direction (80) relative the surface (38) of the rear wheels (34*a*, 34*b*) and/or the front wheels (36*a*, 36*b*) is adjustable by means of an electrically controlled actuator (56) which is controlled by means of control means (70, 71, 72) arranged to provide at least three different control signals, one for left turn, one for right turn and one for center. The control signal for left turn and right turn are arranged for adjusting the pointing direction (80) of the adjustable wheels (34*a*, 34*b*) correspondingly, and the control signal for center is arranged for adjusting the pointing direction (80) of the adjustable wheels (34*a*, 34*b*) to a predetermined value.

10 Claims, 8 Drawing Sheets

(51) Int. Cl.

| | |
|---|---|
| ***B28D 7/00*** | (2006.01) |
| ***E02F 5/02*** | (2006.01) |
| ***E02F 5/14*** | (2006.01) |

(56) References Cited

U.S. PATENT DOCUMENTS

| | | | | |
|---|---|---|---|---|
| 2006/0157045 | A1* | 7/2006 | Galambos | B28D 1/045 125/13.01 |
| 2013/0014737 | A1* | 1/2013 | Brandt | B28D 1/045 125/14 |
| 2014/0028077 | A1* | 1/2014 | Perkins, Jr. | E01C 23/0933 299/10 |

FOREIGN PATENT DOCUMENTS

| | | | |
|---|---|---|---|
| DE | 19931078 | A1 | 1/2001 |
| EP | 1773557 | B1 | 10/2012 |
| WO | 2006017177 | A2 | 2/2006 |
| WO | 2006076346 | A2 | 7/2006 |

OTHER PUBLICATIONS

Chapter I International Preliminary Report on Patentability of International Application No. PCT/SE2014/050051 mailed Jul. 19, 2016.

* cited by examiner

TRACK DRIVE ADJUSTMENT FOR A GROUND SAWING MACHINE

TECHNICAL FIELD

The present disclosure relates to a ground sawing machine comprising a frame supported by rear wheels and front wheels arranged for enabling moving the ground sawing machine over a surface. At least one motor and a saw blade are mounted to the frame, where at least one motor is arranged to propel the saw blade to cut against the surface. The pointing direction relative the surface of the rear wheels and/or the front wheels is adjustable by means of an electrically controlled actuator.

BACKGROUND

In the concrete industry, large slabs of concrete are used to form road beds, building floors and other structures used for its strength and durability. Seams, grooves or other cuts in the concrete may be made in the slabs to form expansion joints, control stress cracks as the slabs cure or to form channels or openings in the slabs to accept other structures. Concrete saws are used to cut the seams, grooves or other openings, and such concrete saws are often very heavy and difficult to move along the concrete slab.

For large or heavy construction applications, heavy self-propelled saws or other large concrete saws are used. During setup and operation of the saw, an operator walks behind the saw to control the direction, cutting speed, cutting depth and other operating conditions under which the saw operates. The saw includes one or more wheels allowing the saw to move along the concrete and a frame supported by the wheels on which is mounted a motor or other power supply for operating a saw blade and often for driving one or more wheels to move the saw along the concrete surface. One or more handles extend behind the saw about the level of an operator's hands to allow the operator to manually position the saw. Typically, the saw blade is in the front of the saw and handles extend behind the saw. For a typical straight cut, the operator aligns the saw blade and often a cutting guide with the intended cutting path. The saw is maneuvered with the saw blade raised above the concrete until the blade and cutting guide are aligned with the cutting path. As the saw blade engages the concrete or other surface to be cut, the blade cuts into the concrete to the desired depth, such as the depth selected by the operator. At the desired depth, the drive wheels are engaged to propel the saw forward to cut the desired slot or groove, which typically follows a straight cut path.

Conventional self-propelled concrete saws have the cutting blade mounted on the left or right side of the machine, so that the saw blade is significantly offset from the center of the machine and supported by the frame of the saw. The drive wheels on the rear axle propel to machine by applying torque and rotation to the drive wheels. When the blade is cutting the work surface, the blade applies an opposite resisting force against the drive from the drive wheels, but the resisting force is off-center to the side of the frame center line.

When the wheels propel the saw forward and the blade is down and cutting on the right side of the saw, the saw tends to veer to the right. Correspondingly, when the blade is cutting on the left side of the saw, the saw tends to veer to the left. To compensate for the blade cutting resistance force created by the saw blade, the operator can physically lean on the handle bars to correct for the changing direction away from the cut path. However, such manual correction is not practical for larger saws or where it may be difficult for the operator to maneuver the saw.

A more efficient way to provide compensation is to align the rear axle to extend in a direction other than perpendicular to the center line of the frame, or in other words the cut path. Re-aligning the rear axle to be other than perpendicular produces a non-parallel propelling force in an attempt to compensate for the blade cutting resistance force produced by the blade while cutting, with the intention of producing a net straight-line movement of the saw along the cut path. Such a re-alignment may be performed manually or electrically, as described in the documents EP 1773557 and U.S. Pat. No. 7,669,589, which are incorporated by reference. Here, an example is provided where a toggle switch is used to steer a saw either to the left or to the right.

However, there is still a desire to further improve an alignment device for concrete saws of this kind.

SUMMARY

It is an object of the present invention to provide an alignment device for concrete saws of the kind discussed initially, where the handling of performing such an alignment is further improved.

Said object is obtained by means of a ground sawing machine comprising a frame supported by rear wheels and front wheels arranged for enabling moving the ground sawing machine over a surface. At least one motor and a saw blade are mounted to the frame, where at least one motor is arranged to propel the saw blade to cut against the surface. The pointing direction relative the surface of the rear wheels and/or the front wheels is adjustable by means of an electrically controlled actuator.

Furthermore, the actuator is controlled by means of control means arranged to provide at least three different control signals; one for left turn, one for right turn and one for center. The control signal for left turn and right turn are arranged for adjusting the pointing direction of the adjustable wheels correspondingly, and the control signal for center is arranged for adjusting the pointing direction of the adjustable wheels to a predetermined value.

According to an example, the control means is comprised in a console which further comprises a display. The display in turn comprises a marker which is arranged to indicate the current adjustment of the pointing direction of the adjustable wheels.

According to another example, if the control signal for center is issued a first time, the actuator is controlled to adjust the pointing direction of the adjustable wheels from a certain value to the predetermined value, and if the control signal for center is issued a second time, without any one of the other control signals being issued in between, the actuator is controlled to adjust the pointing direction of the adjustable wheels to return to the previous value.

According to another example, the predetermined value corresponds to a center value, where the pointing direction of the adjustable wheels is directed along a cutting plane of the saw blade.

According to another example, said pointing direction is detected by means of at least one sensor.

A number of advantages is provided by means of the present invention, mainly it is possible to steer the sawing machine in a desired chosen direction, always being able to return to a predetermined direction by providing only one control signal. This is a major advantage compared to previous arrangements, where only a toggle switch is described, allowing a user to steer either to the right or to the left, but not having any fixed reference direction to which it is easy to return when needed, and from which all operation may start.

BRIEF DESCRIPTION OF THE DRAWINGS

The present invention will now be described more in detail with reference to the appended drawings, where.

DETAILED DESCRIPTION

Figure 1:
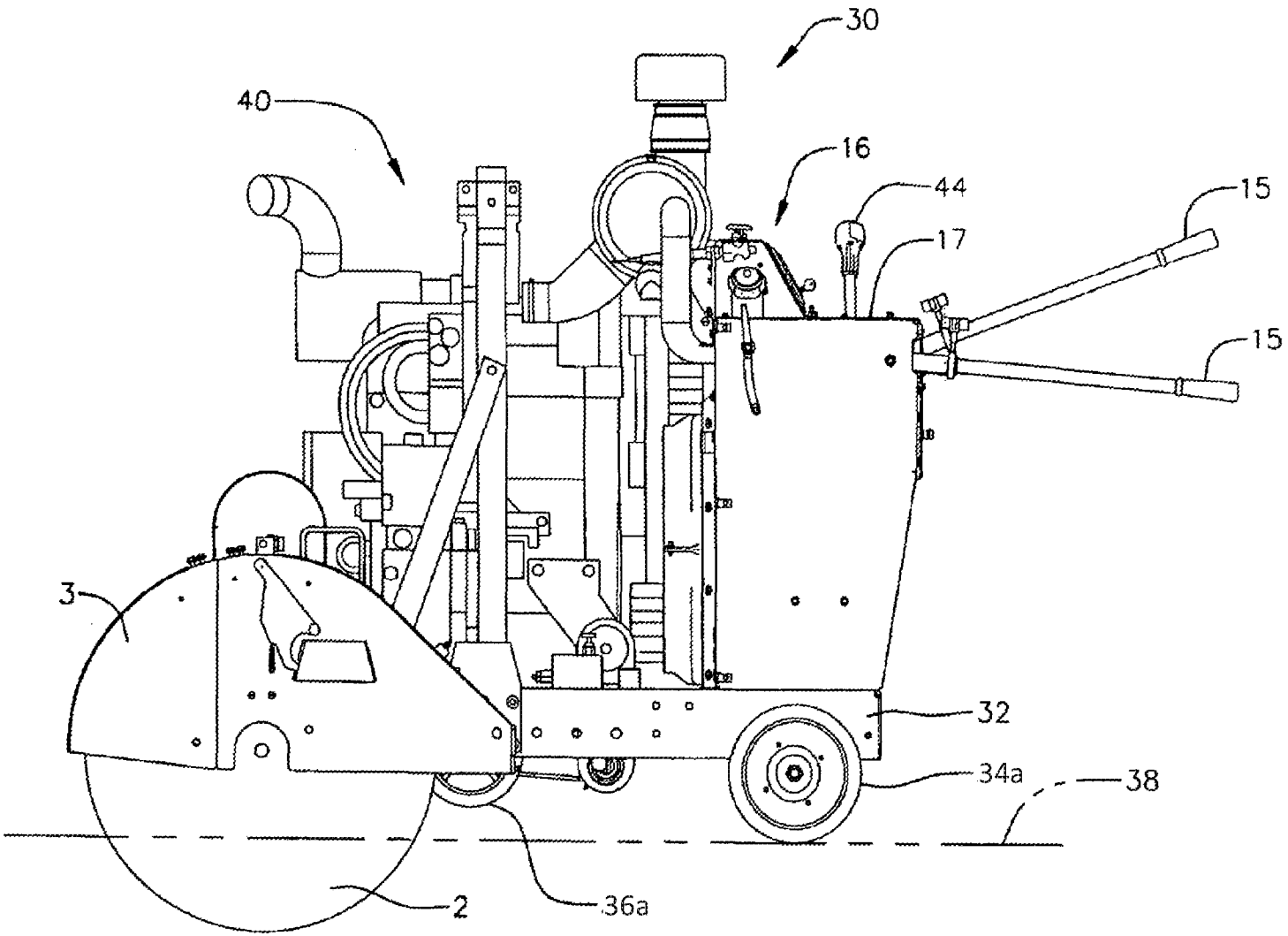
FIG. 1 shows a left side elevation view of a concrete saw.
Figure 2:
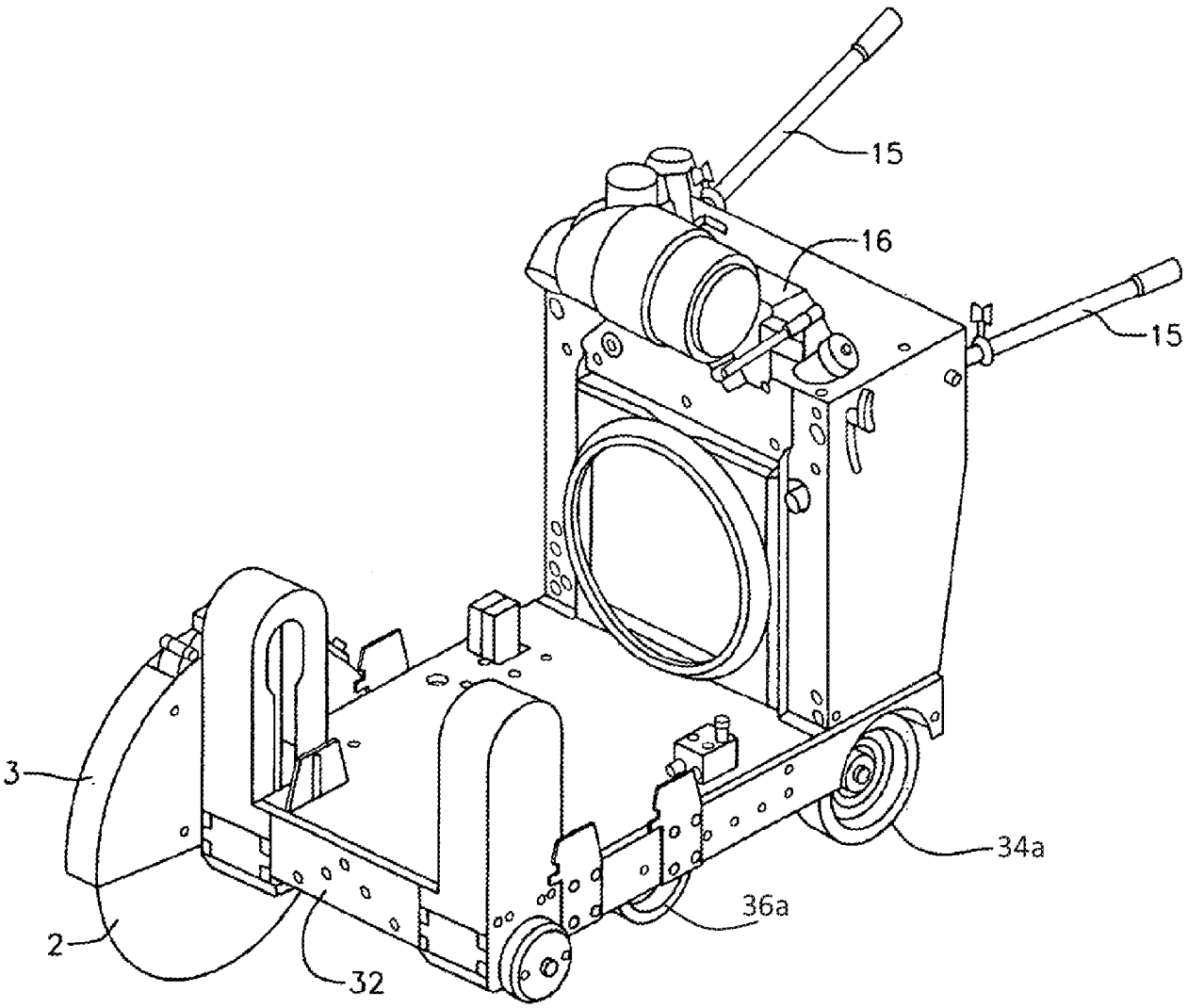
FIG. 2 shows an upper left isometric view of the saw of FIG. 1 with the engine omitted.
Figure 3:
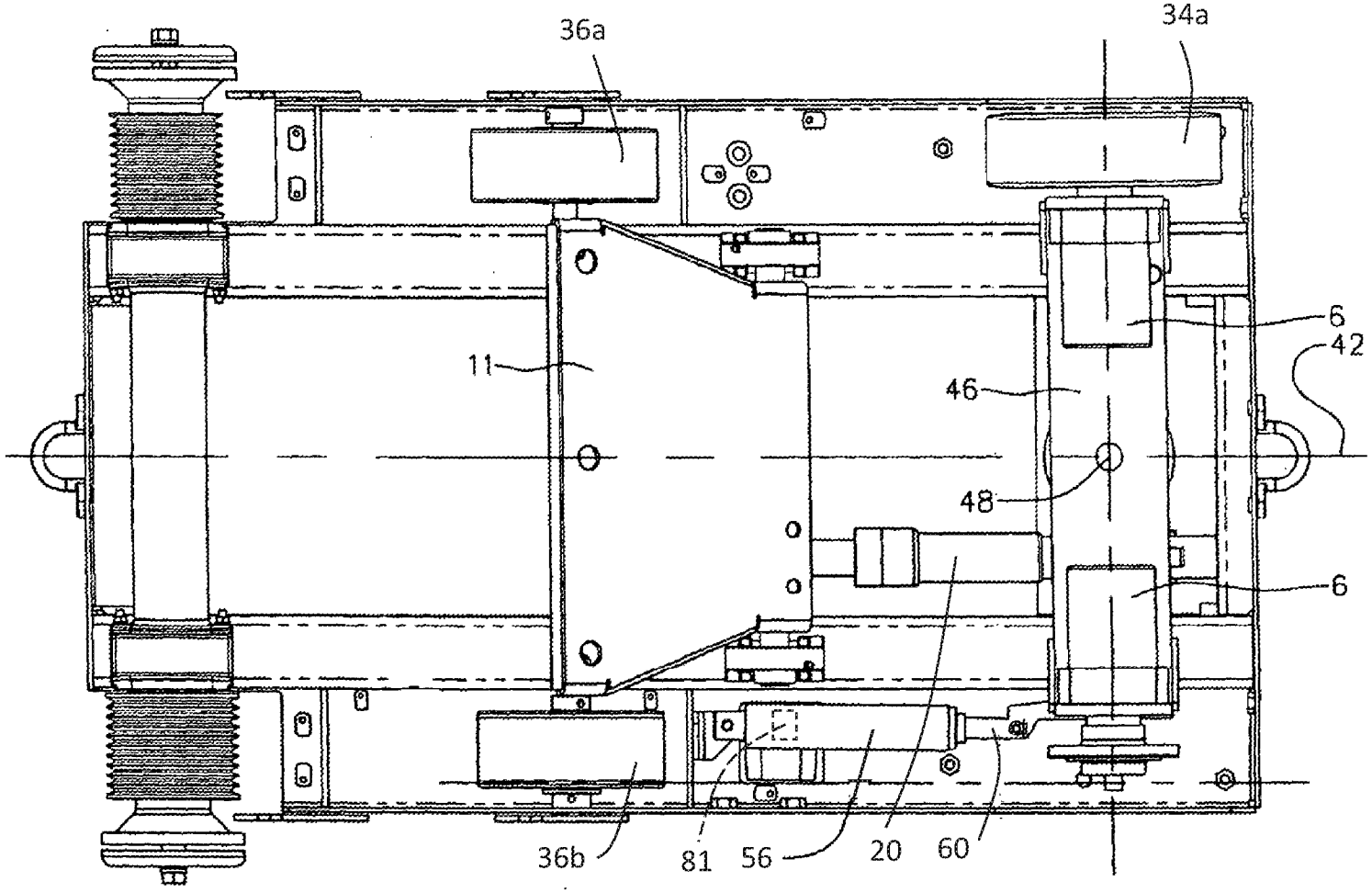
FIG. 3 shows a bottom plan view of the saw of FIG. 1.

With reference to FIG. 1, FIG. 2 and FIG. 3, illustrating a first example, there is a concrete saw 30 with a frame 32 supported by rear wheels 34*a*, 34*b* and front wheels 36*a*, 36*b*. The wheels 34*a*, 34*b*; 36*a*, 36*b* allow the concrete saw 30 to move across a concrete surface 38 in a previously well-known manner. An internal combustion engine 40 is mounted to the frame 32 and provides power both to rotate a circular saw blade 2 and to operate, through a transmission, the rear wheels 34*a*, 34*b*, which thus constitute drive wheels, in order to propel the concrete saw 30. The engine 40 includes a crank shaft (not shown) which drives a blade drive element, for example through a gear box or a pulley around which is positioned a V-belt or other drive element for the saw blade, and drive means for driving the rear wheels 34*a*, 34*b*, which drive means may include a V-belt for a transmission, or a drive mechanism or other means for driving the drive wheels. Other ways of propulsion are of course conceivable, such as for example other mechanical, hydraulic or electrical drive means which are well-known in the art.

Figure 4:
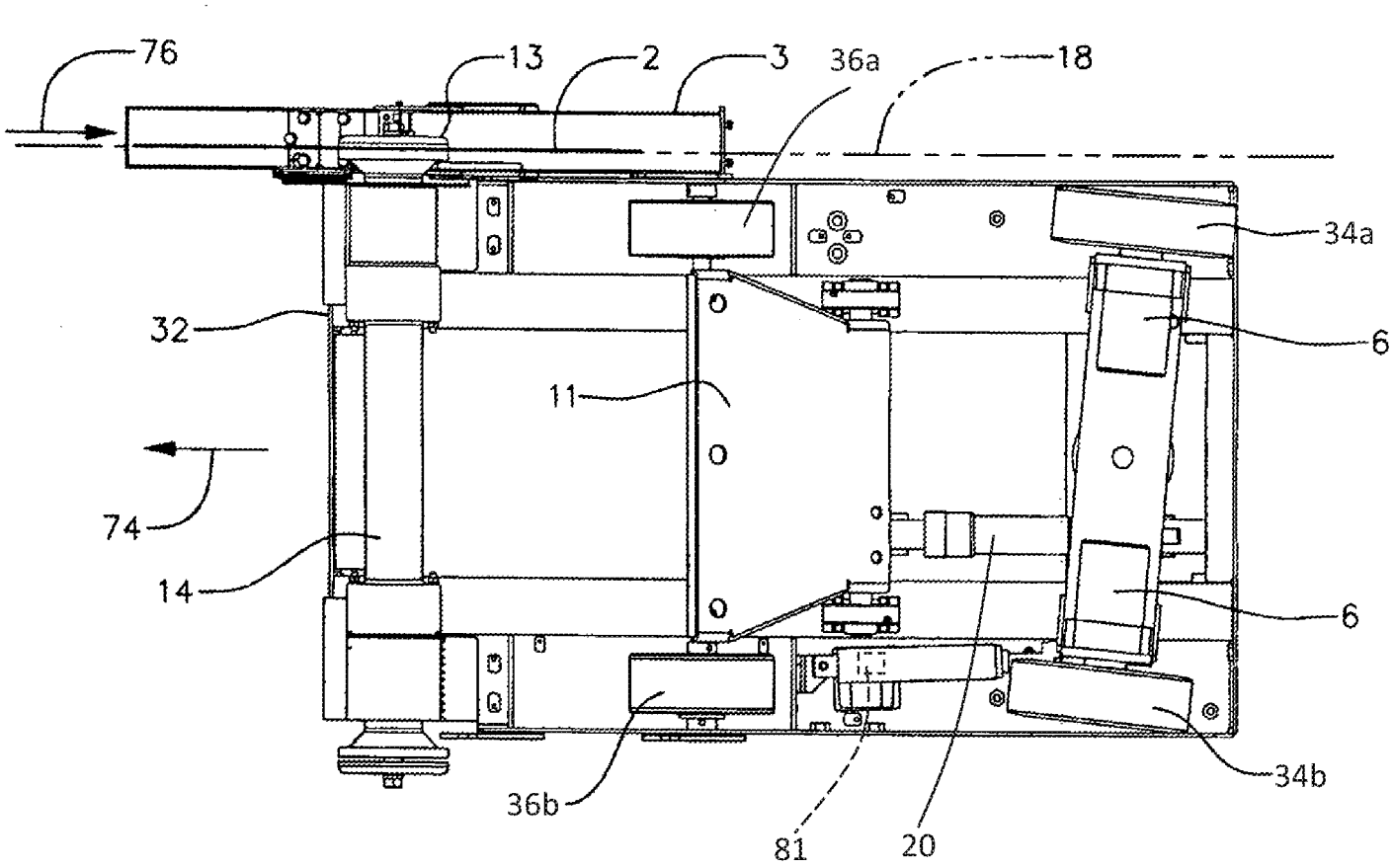
FIG. 4 shows a bottom plan view of the saw of FIG. 1 having a saw blade mounted for a left-hand saw cut and with a linear actuator retracted to move the saw drive assembly.
Figure 5:
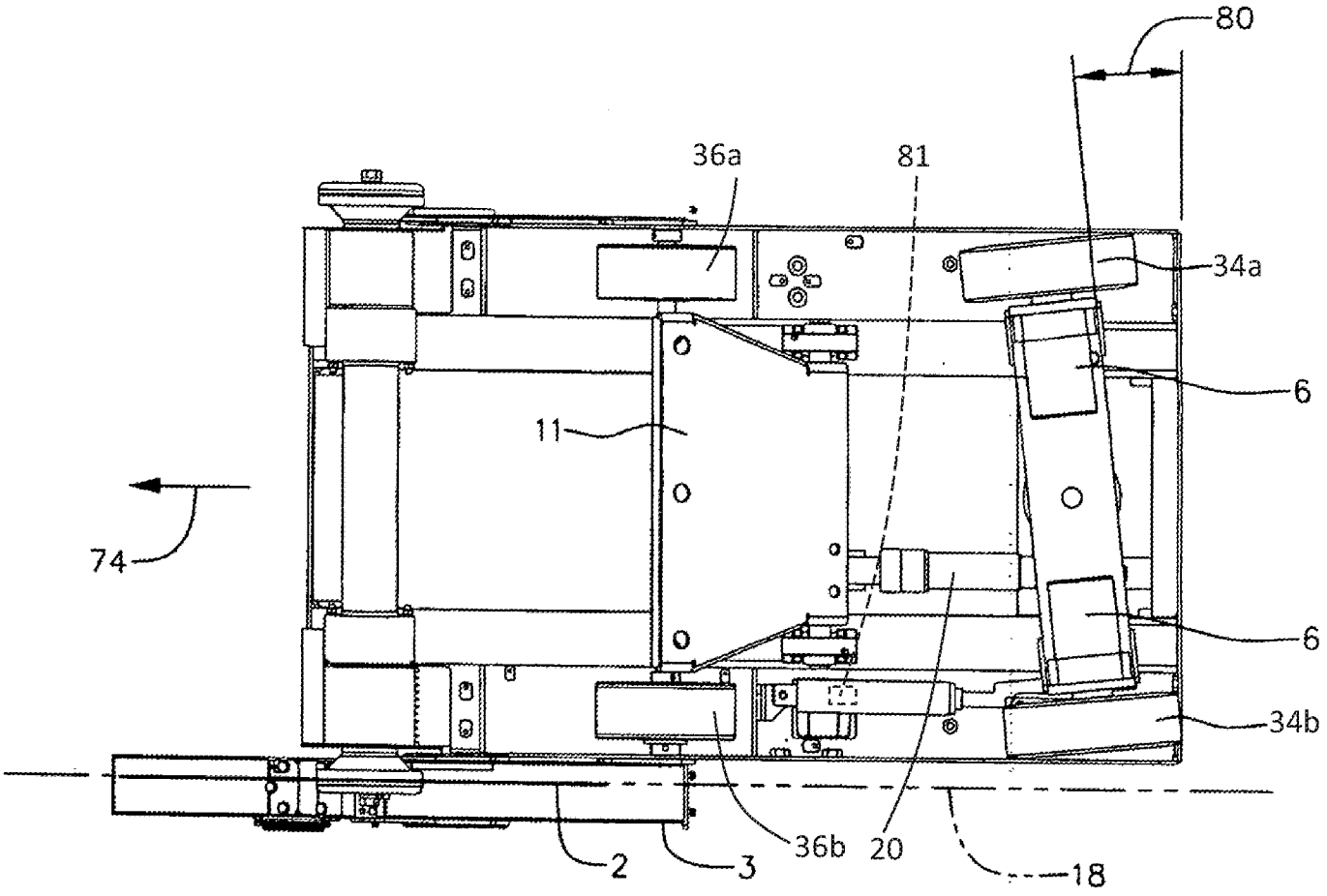
FIG. 5 shows a bottom plan view of the saw of FIG. 1 having a saw blade mounted for a right-hand saw cut and with a linear actuator extended to move the saw drive assembly.

As shown in FIG. 4, the saw blade 2 is mounted to a blade shaft 14 and is held in place through blade flanges such as at 13. The saw blade 2 may be mounted on the blade shaft on the right side of the frame 32, as shown in FIG. 2 and FIG. 5 for right hand saw cut, or on the left side of the frame 32, as shown in FIG. 4, for left-hand saw cut. Therefore, in the concrete saws shown in the drawings, the saw blade 2 is mounted offset from a center line 42 of the concrete saw 30 as illustrated in FIG. 3, the center line 42 extending in the general direction of motion 74 of the concrete saw 30. As shown in FIG. 1 and FIG. 2, a blade guard 3 extends over at least the upper portion of the saw blade 2 to help control debris and slurry spread that may be produced during cutting.

With continued reference to FIG. 1, FIG. 2 and FIG. 3, an operator (not shown) uses handles 15 to position the concrete saw 30, and can move the concrete saw 30 by operating the drive assembly to propel the saw forward. Movement of the saw through the rear wheels 34*a*, 34*b* can be controlled through a drive control 44. The cutting speed or forward progress can be controlled in part by controlling the power applied to the drive wheels 34*a*, 34*b*. The operator also controls blade depth by suitable positioning of a hinged front axle assembly 11, which may hydraulically raise and lower the front end of the saw. The front axle assembly 11 is supported on the concrete or other surface through the front wheels 36*a*, 36*b*. The front axle assembly 11 pivots downward away from, and upward toward, the saw frame 32 when, as shown in this example, a height adjustment cylinder 20 as shown in FIG. 3-7 extends and retracts, thereby raising and lowering the saw 30.

Furthermore, the operator can control the cutting direction by moving a drive assembly to change the direction of motive force applied through the drive assembly to the frame and along the surface 38. The drive assembly can take any number of configurations, and in this example, with reference to FIG. 3, FIG. 4, FIG. 5 and FIG. 6, the drive assembly comprises the rear wheels 34*a*, 34*b* mounted to a movable axle 46. In this way, the rear wheels 34*a*, 34*b* are movable relative to the frame 32 so as to change their direction of drive relative to the front-to-back direction of the frame, i.e. relative the center line 42. The movable axle 46 comprises a relatively flat upper plate and downwardly extending side portions at respective ends of the upper plate for supporting the rear wheels 34*a*, 34*b*. However, the movable axle 46 can take a number of other configurations while still allowing movement of the drive assembly relative to the frame.

The movable axle 46 is pivotally coupled to the frame 32 through a connection provided by a spindle 48 supported by a bearing. The movable axle 46, with the rear wheels 34*a*, 34*b*, can pivot about the spindle 48. Pivoting of the axle with the drive wheels allows the direction of motive force produced through the drive wheels to be changed relative to the frame 32. The pivoting allows the drive assembly to be movable relative to the frame 32, thereby allowing changes to the direction of motive force produced through the rear wheels 34*a*, 34*b* as illustrated in FIG. 4, FIG. 5 and FIG. 6.

As shown in FIG. 3, where the right rear wheel 34*b* is removed for the sake of clarity, a linear actuator 56 is connected to the movable axle 46 by means of a rod 60, and is arranged to pivot the movable axle 46 around the spindle 48. In this way, a desired steering angle 80 relative to the frame 32 may be set, as shown in FIG. 5. The desired steering angle 80 is detected by means of any suitable sensor 81, for example positioned in the actuator 56 as indicated in FIG. 3-7. Although not shown in any drawings, external positions of such a sensor 81 are also conceivable. The sensor 81 may be in an uncomplicated form such connected to a screw rod in the actuator 56, or in the form of a more advanced sensor that for example measures by means of laser light. These are only examples, any type of suitable sensor or detector may be used.

The linear actuator 56 is positioned under the frame 32 enabling the rod 60 to move approximately parallel to the center line 42 of the frame 32. The linear actuator 56 is positioned on the concrete saw 30 in such a way that the linear actuator 56 can move the drive assembly through the desired range of motion. The linear actuator 56 is arranged move the axle 46 through a significant angle both in the positive or clockwise direction and in the negative or counter clockwise direction relative to the precisely transverse position of the axle as viewed in FIG. 3.

Figure 6:
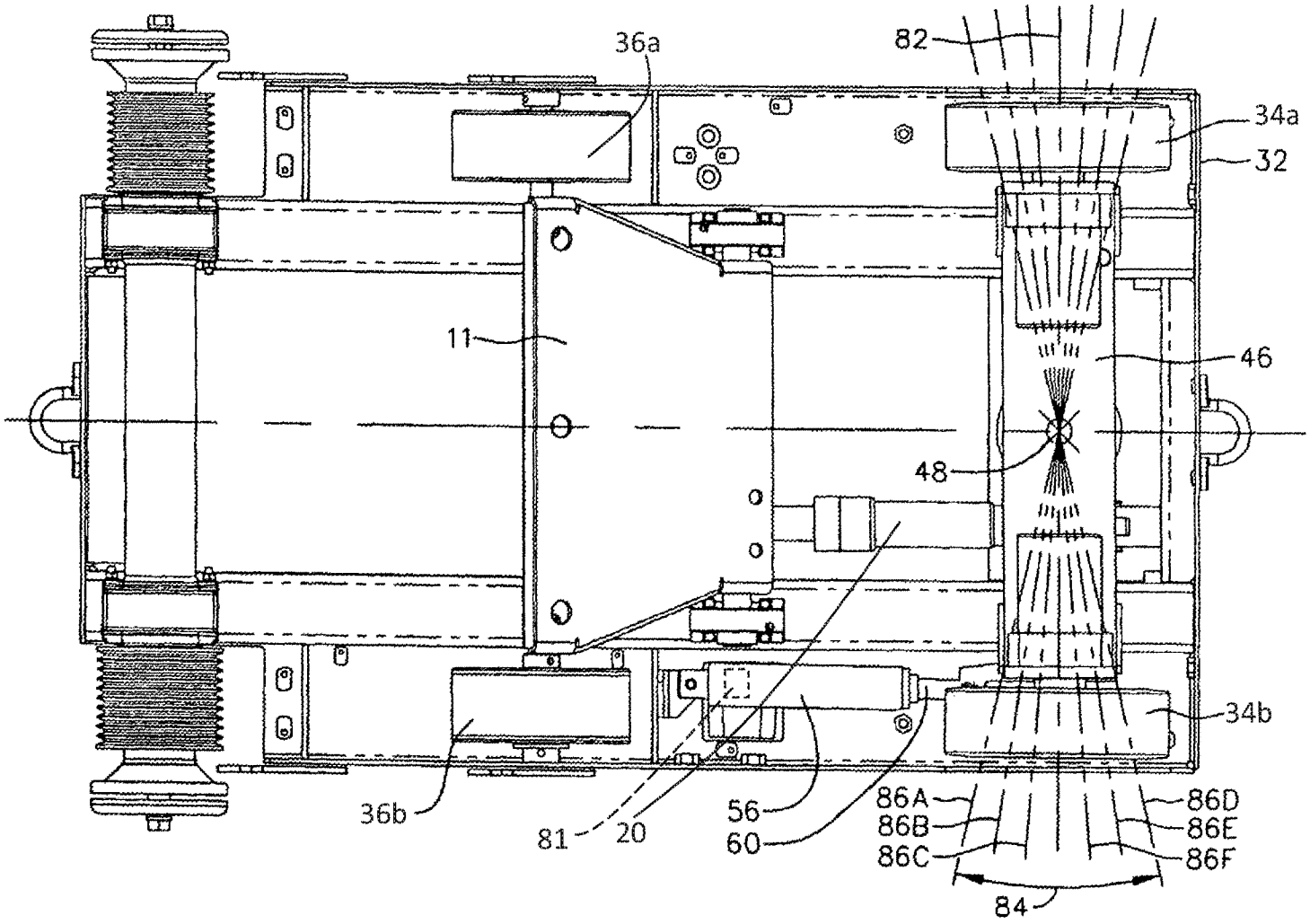
FIG. 6 shows a bottom plan view of the saw similar to that of FIG. 3 showing examples of a range of motion for pivoting of the movable drive assembly.

An example of a possible range of motion of the movable axle 46 is depicted in FIG. 6 and is there represented by an arc 84. The lines 86A-86C represent examples of axle angles at which the axle can be placed for moving the saw right. However, it should be understood that the lines 86A-86C represent individual axle positions, but that the axle can be moved to a position at any desired location within the range of motion. Conversely, if a designer wants to limit axle positions to discrete angles, the movable drive assembly and/or the moving element can be configured accordingly. Likewise, the lines 86D-86F represent examples of axle angles at which the axle can be placed for moving the saw left. In this case as well, the axle 46 can be moved to a position at any desired location within the range of motion for moving the saw left.

Figure 8:
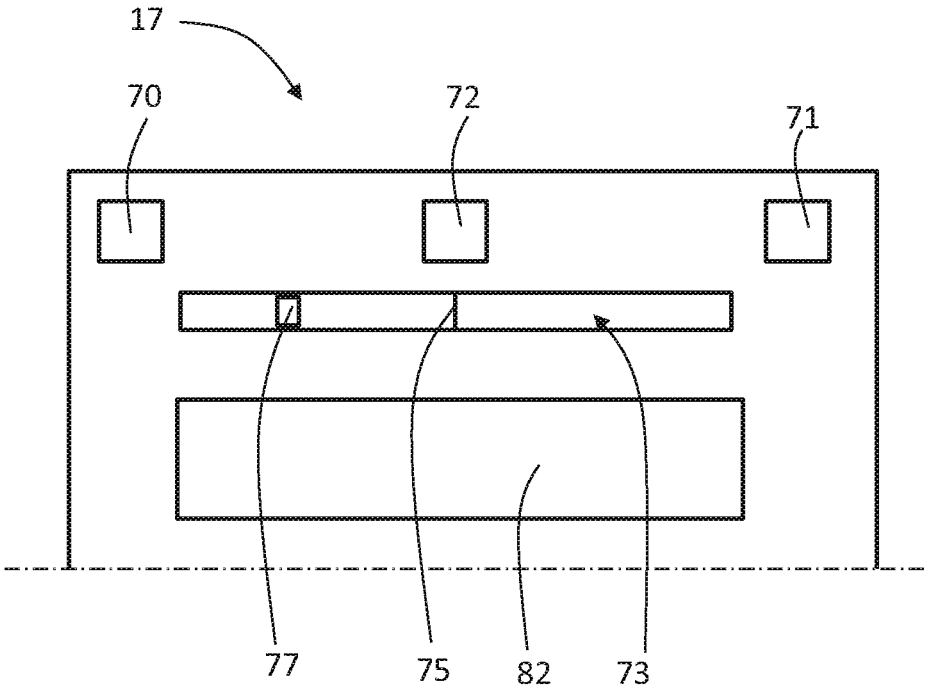
FIG. 8 schematically shows an operator's console arrangement for changing or adjusting the drive direction of a saw blade.

With reference to FIG. 8, the linear actuator 56 and the position of the rod 60 are controlled by means of an operator's console 17.

According to the present invention, the console 17 comprises three buttons, a left button 70, a right button 71 and a center button 72. The angle of the movable axle 46 is controlled by these buttons. Pressing the left button 70 will make the movable axle 46 turn to the right making the concrete saw 30 steer to the left. Pressing the right button 71 will make the movable axle 46 turn to the left making the concrete saw 30 steer to the right. The movable axle 46 can be set in any angle in a range of for example approximately +/−5 degrees. For example the movable axle's 46 turning speed is approximately 1 degree/sec.

Furthermore, by pressing the center button 72, the movable axle 46 turns to its calibrated center position where the rear wheels 34*a*, 34*b* are arranged along the center line 42 as shown in FIG. 3.

The console 17 comprises a display 73 which in turn comprises a marker 77. When the movable axle 46 is turned by means of pressing any one of the buttons 70, 71, 72, this is indicated in the display by the marker 77 that moves along the extension of the display. The display further comprises a center position indication 75. When the center button 72 is pressed, the marker 77 moves to the center position indication 75.

If the center button 72 is pressed a second time, without pressing the left button 70 or the right button 71 in between, the movable axle 46 will return to the previous angle. The marker 77 will also return to the position it had before the center button 72 was pressed the first time. For example, this provides an enhanced degree of convenience when the concrete saw 30 is stopped and moved backwards before continuing sawing in the forward direction again. Then, first the center button 72 is pressed a first time and the concrete saw 30 may easily be moved backwards since the movable axle 46 then is moved to its center position. When it is desired to continue to saw in the forward direction, the center button 72 is pressed a second time to have the movable axle 46 return to the previous angle.

The center position of the movable axle 46 can be calibrated to any angle within the movable axle 46 angle range 84 as indicated in FIG. 6. This is done from a setup menu at a touch-screen 82 comprised in the console. The center position indication 75 of the display 73 may be fixed, but it is conceivable that is arranged to move to each calibrated value, such that the center position indication 75 indicates the present calibrated value. Generally, the center position corresponds to a center value, which in turn is constituted by a predetermined value that may be adjustable according to the above.

As an example, at least initially, the center position of the movable axle 46 may be directed such that the desired steering angle 80 is directed along a cutting plane 18 of the saw blade 2 in its idle condition.

In order to be able to calibrate the center position of the movable axle 46, and to continuously keep track of the movable axle 46, input from the sensor 81 is used.

The present invention is not limited to the above, but may vary freely within the scope of the appended claims. For example, the connection provided by the spindle 48 is a form of a swivel coupling, but other configurations can be used as well, for example bearing surfaces, low friction surfaces, or the like. The pivoting coupling of the axle relative to the frame can be located other than the center of the axle, or the center of the frame, as well. For example, the pivot point can be off-center, and can be closer to one drive wheel than to the other, and the pivot axis can be positioned above a wheel.

Furthermore, the rear wheels 34*a*, 34*b* can have their drive directions adjusted either individually or simultaneously. In one configuration, the left rear wheel 34*a* and the right rear wheel 34*b* can be independently controlled by means of respective linear actuators mounted to the desired locations on the respective drive plates. In such a configuration, the drive wheels can be pivoted together, or independently, through independent and/or parallel operation of the respective linear actuators.

Figure 7:
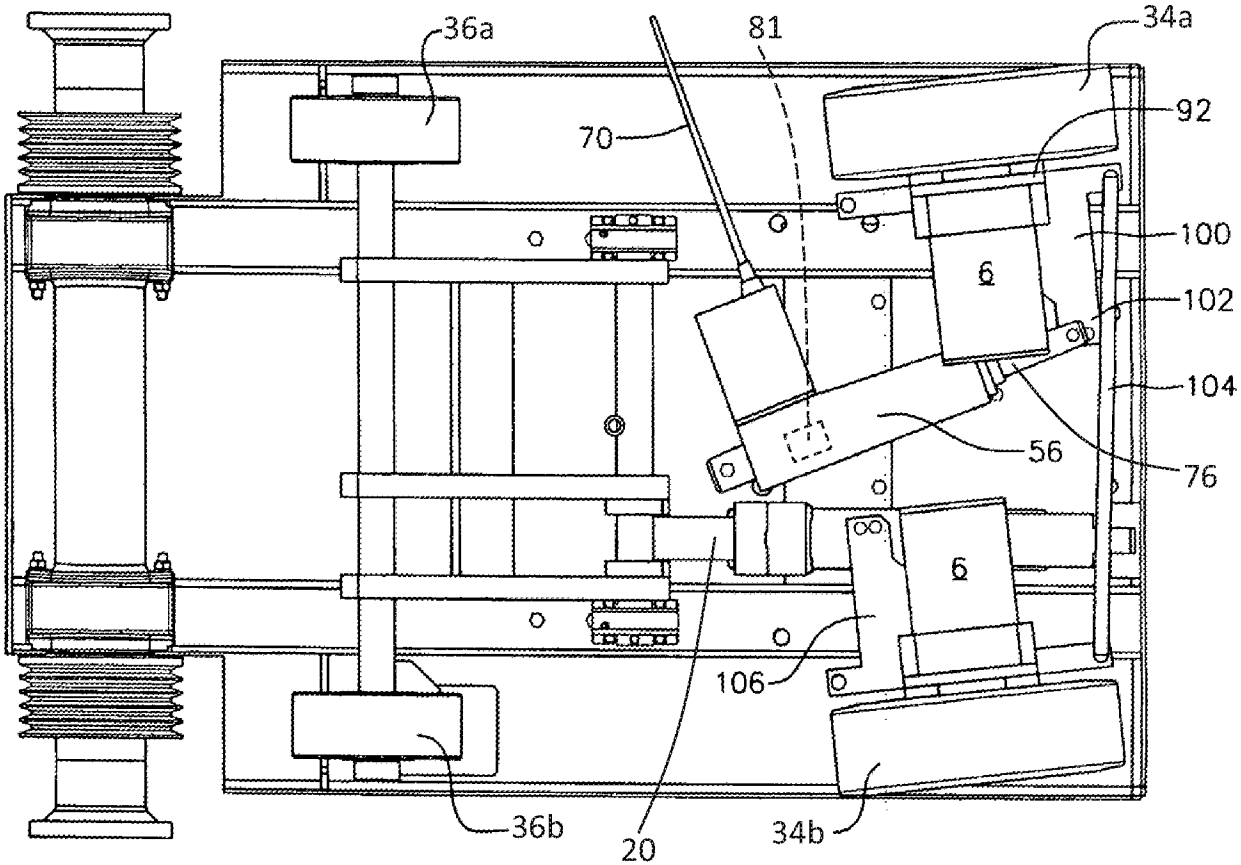
FIG. 7 shows a bottom plan view of another example of a movable drive assembly for a concrete saw.

An example of an alternative arrangement is shown in FIG. 7, where the rear wheels 34*a*, 34*b* are mounted to corresponding first drive plate 100 and second drive plate 106. The first drive plate 100 is connected to a rod 76 which in turn is connected to a linear actuator 56 of the same kind as described previously. The linear actuator 56 is coupled to a link portion 102 on the first drive plate 100 via the rod 76 for moving the rear wheels 34*a*, 34*b* under the influence of the linear actuator 56. The assembly includes a tie rod 104 coupling the first drive plate 100 to the second drive plate 106. In this configuration, the linear actuator moves both drive wheels at the same time by moving the left rear wheel 34*a*, and then the tie rod 104 moves the right rear wheel 34*b*, preferably in unison.

The linear actuator 56 disclosed in the examples above may be any suitable linear actuator for moving an end 58 of a rod 60 over a continuous linear distance or over a series of discrete linear distances to achieve the desired movement of the drive assembly. The actuator 56 may also be any other suitable moving device, linear or nonlinear, continuous or discrete increments, as desired, for achieving the desired movement of the drive assembly. The actuator 56 may for example be constituted by an electro-mechanical linear actuator with an electric motor turning a threaded shaft or nut to effect a change in the length of the actuator. The moving element could also be a hydraulic cylinder, a motor-driven screw feed, a rotary actuator, or the like. In any case, the actuator is electrically controlled.

The combustion engine 40 may provide power only to the saw blade, the rear wheels being propelled by one or more separate motors 6 as shown in FIG. 3-5 and FIG. 7. Here, the separate motors 6 may be in the form of hydraulic motors which are powered by the combustion engine 40. All engines may be in the form of electrical motors.

The concrete saw 30 may be generally be any suitable ground sawing machine which is arranged for sawing through a surface 38. The surface may not be concrete, but may for example be constituted by asphalt instead.

In the examples, the rear wheels 34*a*, 34*b* constitute drive wheels. It is conceivable that the front wheels 36*a*, 36*b* constitute drive wheels, either alone or in combination with the rear wheels 34*a*, 34*b*. The movable axle 46, or other arrangement for adjusting drive direction, has been described to be arranged together with the rear wheels 34*a*, 34*b* and the front wheels 36*a*, 36*b*, but it is also conceivable that the front wheels 36*a*, 36*b* have such a movable axle 46 or other arrangement for adjusting drive direction, irrespective of which wheels that constitute drive wheels.

Instead of control buttons 70, 71, 72, there could be any other suitable control means by means of which three different control signals may be provided, one for left turn, one for right turn and one for center. An example of such a control means could be a toggle switch like a joy-stick, which either may be depressed, or which may have three different toggle directions. There could also be two buttons, one for left and one for right, where a simultaneous depression activates the center function. Many other examples are of course conceivable.

The major advantage of the present invention is presence of a fixed reference direction to which it is easy to return when needed, and from which all operation may start, by providing only one control signal. Additionally, according to an example, it is possible to return to the previous direction if desired by only providing said control signal once more.

In a general, the actuator 56 is controlled by means of control means 70, 71, 72 by means of which three different control signals may be provided, one for left turn, one for right turn and one for center. The control signal for left turn and right turn are arranged for adjusting the pointing direction of the adjustable wheels 34*a*, 34*b* correspondingly, and the control signal for center is arranged for adjusting the pointing direction of the adjustable wheels 34*a*, 34*b* to a predetermined value. Said pointing direction, which in the examples above is in the form of the desired steering angle 80, is detected by means of at least one sensor 81.

Additionally, the display may be added. The display 73 may be of any suitable kind, for example in the form of an LCD (Liquid Crystal Display) or LED (Light Emitting Diode) display.

By means of the console 17 according to the above, it is possible to:

- View the angle of the adjustable wheels in a graphical display.
- Steer the sawing machine in a predetermined direction, such as a center direction, by pressing only one button that will make the adjustable wheels to move to the calibrated position.
- Return to a previous direction by pressing only one button.
- Avoid any mechanical calibration.

The movable drive assembly and the moving element of the examples described herein can be used to more easily adjust a movable axle, particularly a rear drive axle, and more easily adjust for a variety of operating conditions. Adjustments can be made before or during operation of the saw, and without the use of tools. Additionally, the need for the operator to manually adjust the saw position through the handle bars 15 can be reduced or eliminated. Having thus described several exemplary implementations of the invention, it will be apparent that various alterations and modifications can be made without departing from the inventions or the concepts discussed herein. Such operations and modifications, though not expressly described above, are nonetheless intended and implied to be within the spirit and scope of the inventions. Accordingly, the foregoing description is intended to be illustrative only.

The touch-screen 82 can be of any suitable kind and size. Other means for inputting data are also conceivable, for example an ordinary keypad and an LCD screen. The console 17 may comprise further functions items.

The invention claimed is:

1. A ground sawing machine comprising a frame supported by rear wheels and front wheels arranged for enabling moving the ground sawing machine over a surface, wherein one of the rear wheels or front wheels are configured as adjustable wheels, wherein at least one motor and a saw blade are mounted to the frame, the at least one motor being arranged to propel the saw blade to cut against the surface, wherein a pointing direction of the adjustable wheels relative to the surface is adjustable via an electrically controlled actuator, wherein the actuator is controlled via application of any one of at least three different electric control signals, one for left turn, one for right turn and one for center, wherein the control signals for left turn and right turn cause the actuator to be operated to adjust the pointing direction of the adjustable wheels correspondingly, and wherein the control signal for center causes the actuator to be operated to adjust the pointing direction of the adjustable wheels to a predetermined value.

2. The ground sawing machine according to claim 1, wherein the control signals are generated responsive to operation of respective buttons disposed at a console, the console further comprising a display, the display in turn comprises a marker which is arranged to indicate a current adjustment of the pointing direction of the adjustable wheels.

3. The ground sawing machine according to claim 2, wherein the predetermined value is adjustable, and wherein the display comprises a center position indication that is configured to indicate each adjustment of the predetermined value such that the center position indication indicates a present adjustment of the predetermined value.

4. The ground sawing machine according to claim 2, wherein the console comprises three buttons including a left button, a right button and a center button.

5. The ground sawing machine according to claim 1, wherein if the control signal for center is issued a first time, the actuator is controlled to adjust the pointing direction of the adjustable wheels from a present value to the predetermined value, and if the control signal for center is issued a second time, without any other control signals being issued in between, the actuator is controlled to adjust the pointing direction of the adjustable wheels to return to a previous value.

6. The ground sawing machine according to claim 1, wherein the predetermined value at least initially corresponds to a center value, where the pointing direction of the adjustable wheels is directed along a cutting plane of the saw blade.

7. The ground sawing machine according to claim 1, wherein said pointing direction is detected by at least one sensor or detector.

8. The ground sawing machine according to claim 7, wherein the at least one sensor or detector comprises at least one position sensor is arranged on or in the actuator.

9. The ground sawing machine according to claim 1, wherein the predetermined value comprises a center position of the adjustable wheels.

10. The ground sawing machine according to claim 9, where the center position is a calibrated center position.

* * * * *